US005855819A

United States Patent [19]

DeSimone et al.

[11] Patent Number: 5,855,819

[45] Date of Patent: Jan. 5, 1999

[54] SYNTHESIS OF CONDUCTIVE POLYMERS IN LIQUID AND SUPERCRITICAL $CO_2$

[75] Inventors: Joseph M. DeSimone, Chapel Hill, N.C.; Yizeng Ni, State College, Pa.

[73] Assignee: University of North Carolina at Chapel Hill, Chapel Hill, N.C.

[21] Appl. No.: 825,119

[22] Filed: Mar. 27, 1997

[51] Int. Cl.[6] ..... H01B 1/12

[52] U.S. Cl. ..... 252/511; 524/424; 526/89

[58] Field of Search ..... 252/511; 524/424; 526/89

[56] References Cited

U.S. PATENT DOCUMENTS 4,551,403 11/1985 Miyakawa ..... 430/58

4,882,107 11/1989 Cavender ..... 264/51

5,435,932 7/1995 Bryant ..... 252/77

5,509,959 4/1996 Nielson ..... 106/287.35

*Primary Examiner*—Paul R. Michl

*Attorney, Agent, or Firm*—Myers Bigel Sibley & Sajovec

[57] ABSTRACT

A method of forming an electrically conductive polymer comprises providing a reaction mixture in carbon dioxide, the reaction mixture comprising at least one monomer and a charge transfer agent. The monomer is then polymerized in the carbon dioxide to form a polymer, and the polymer is doped with the charge transfer agent so that the polymer is an electrically conductive polymer.

23 Claims, No Drawings

SYNTHESIS OF CONDUCTIVE POLYMERS IN LIQUID AND SUPERCRITICAL $CO_2$

FIELD OF THE INVENTION

The present invention relates to the synthesis of electrically conductive polymers in gaseous, liquid, or supercritical medium.

BACKGROUND OF THE INVENTION

The recent development and production of conductive polymers has become significant due to the increased number of applications which incorporate the polymers. Such applications are related to, for example, electrochemical devices, chemical and optical sensors, and light emitting devices. Such polymers are important since they potentially display high room temperature conductivity, and can also exhibit superconductivity at reduced temperatures.

A number of monomers are used to form conductive polymers including, for example, sulfurnitride, acetylene and related derivatives, phenylene and related derivatives, and heterocycles such as pyrrole. Several processes are currently employed for synthesizing conductive polymers. One process typically involves providing one or more monomers in an organic solvent, along with a charge transfer or oxidizing agent and a dopant. The monomer is oxidized which forms a polymer in the solvent medium. In one of the conventional processes in conductive polymer synthesis, the oxidant is reactive in both the oxidation polymerization and a doping reaction. The oxidative agent essentially converts an insulating organic polymer to a conducting polymer with near metallic conductivity.

The use of organic solvents, however, is becoming disadvantageous. Specifically, these solvents are potentially environmentally hazardous. Additionally, other problems exist with respect to dispersion of dopant in the polymeric material. Moreover certain conductive polymers, e.g., polypyrrole and polyaniline, tend to be largely insoluble in organic solvents, thus restricting their application in traditional processing operations.

In view of the above, it is an object of the present invention to provide a method of forming electrically conductive polymers which employs a reaction medium capable of addressing the above difficulties.

SUMMARY OF THE INVENTION

To the above end and others, the present invention provides a method of forming an electrically conductive polymer. The method comprises providing a reaction mixture in carbon dioxide, with the reaction mixture comprising at least one monomer and a charge transfer agent. The monomer is then polymerized in the carbon dioxide to form a polymer, and the polymer is doped with the charge transfer agent so that the polymer is an electrically conductive polymer.

The carbon dioxide may be employed in various forms including gaseous, liquid, and supercritical states.

Preferably, the monomer is selected from the group consisting of pyrrole, methylpyrrole, 2,2'-bithiophene, 3-n-butylthiophene, $S_4N_4$, 1,6-heptadiene, butenyne, benzene, p-dichlorobenzene, aniline, furan, thiophene, selenophene, pyrrole, thieno[2,3-b]thiophene, thieno[3,2-b]pyrrole, isothianaphlene, fluorene, carbazole, dibenzothiophene, dithieno[3,2-b:2',3'-d]thiophene, cyclopenta[2, 1-b:3', 4'-b] dithiophen-4-one, and mixtures thereof.

The charge transfer agent is preferably selected from the group consisting of $Fe(ClO_4)_3$, $FeCl_3$, $Fe(NO_3)_3$, $(NH_4)Fe(SO_4)_2$, $K_2S_2O_8$, $Cu(BF_4)_2$, $FeCl_3.6H_2O$, $KIO_3$, $(NH_4)_2S_2O_8$, $K_2Cr_2O_7$, and mixtures thereof.

The method of the present invention may also include additional steps. In one embodiment, the method further comprises the step of separating the electrically conductive polymer from the reaction mixture. In another embodiment, the method may further comprise the step of washing the electrically conductive polymer with an aqueous solution.

DETAILED DESCRIPTION OF THE INVENTION

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art.

The present invention relates to a method of forming an electrically conductive polymer. The method includes providing a reaction mixture in carbon dioxide, with the reaction mixture comprising at least one monomer and a charge transfer agent. Subsequently, the monomer is polymerized in the carbon dioxide to form a polymer, and the polymer is doped with the charge transfer agent so that the polymer is an electrically conductive polymer.

For the purposes of the invention, carbon dioxide is employed as a fluid in the reaction mixture in a liquid, gaseous, or supercritical phase. If liquid $CO_2$ is used, the temperature employed during the process is preferably below 31° C. If gaseous $CO_2$ is used, it is preferred that the phase be employed at high pressure. As used herein, the term "high pressure" generally refers to $CO_2$ having a pressure from about 20 to about 300 bar. In a preferred embodiment, the $CO_2$ is utilized in a "supercritical" phase. As used herein, "supercritical" means that a fluid medium is at a temperature that is sufficiently high that it cannot be liquified by pressure. The thermodynamic properties of $CO_2$ are reported in Hyatt, *J. Org. Chem.* 49: 5097–5101 (1984); therein, it is stated that the critical temperature of $CO_2$ is about 31° C. In particular, the methods of the present invention may be carried out at a temperature range which typically has a low end of about −50° C. or about 0° C., and has a high end preferably of about 35° C. or about 100° C. The pressures employed typically have a low end of about 800 psia or about 1000 psia, and a high end of about 3000 psia or about 10,000 psia.

Various monomers may be employed for the purposes of the invention. Exemplary monomers include, but are not limited to, pyrrole, methylpyrrole, 2,2'-bithiophene, 3-n-butylthiophene, $S_4N_4$, 1,6-heptadiene, butenyne, benzene, p-dichlorobenzene, aniline, furan, thiophene, selenophene, thieno[2,3-b]thiophene, thieno[3,2-b]pyrrole, isothianaphlene, fluorene, carbazole, dibenzothiophene, dithieno[3,2-b:2',3'-d]thiophene, cyclopenta[2,1-b:3',4'-b] dithiophen-4-one, n-hexylpyrrole, and acetylene. Mixtures of any of the monomers may be utilized.

Numerous suitable charge transfer agents are used in the present invention. For the purposes of the invention, a charge transfer agent can be defined generally as a chemical reagent that results in the formation of a chain transfer agent complex when added to the system. Preferred charge transfer agents include, but are not limited to, $Fe(ClO_4)_3$, $FeCl_3$, $Fe(NO_3)_3$, $(NH_4)Fe(SO_4)_2$, $K_2S_2O_8$, $Cu(BF_4)_2$, $FeCl_3.6H_2O$, $KIO_3$, $(NH_4)_2S_2O_8$, $I_2$, $AsF_5$, and $K_2Cr_2O_7$. Mixtures of any of the above may be used. The charge transfer agent is used in varying amounts preferably from about 0.01 to about 15 percent based on the weight of the monomer.

A vast number of electrically conductive polymers are produced by the method of the invention. For the purposes of the invention, the term "electrically conductive polymers" is meant to include, but not be limited to, all polymeric species that have a conjugated main structure or electron rich heteroatoms. Such heteroatoms may include, for example, oxygen, sulfur, nitrogen, phosphorous, selenium, or other appropriate elements. Exemplary conductive polymers include, but are not limited to, poly(sulfurnitride), polyacetylene, poly(phenylacetylene), poly(propiolonitrile), poly(3-chloro-1-propyne), poly(trifluoro-1-propyne), poly (phenylene vinylene), poly(vinylene sulfide), poly (vinylenephenylene pyrrole), poly(p-phenylene), poly(p-phenylene oxide), poly(p-phenylene sulfide), polyaniline, polypyrrole, poly(2,2'-bithiophene), polymethylpyrrole, polythiophene, and mixtures thereof. Poly(3-alkylthiophene) may also be formed, wherein the term "alkyl" refers to groups having between 1 and 18 carbon atoms. Electrically conductive polymers based on fused ring monomers described herein may also be formed, along with poly(heterocycles). Copolymers and mixtures of any of the above conductive polymers may be formed by the invention. The electrically conductive polymers preferably have a conductivity ranging from about $10^{-2}$ to about $10^{4}$ $Scm^{-1}$, more preferably from about $10^{-1}$ to about $10^{4}$ $Scm^{31\ 1}$, and most preferably from about $10^{2}$ to about $10^{4}$ $Scm^{-1}$. The above conductivities were measured using a four probe method at room temperature.

The reaction mixture of the invention may also include other suitable components such as, for example, a co-solvent or a surfactant. Exemplary co-solvents include, but are not limited to, methanol, water, aliphatic hydrocarbons, and mixtures thereof. The co-solvents are employed in varying amounts, typically between about 0 and about 15 percent based on the total monomer weight. Surfactants are used to control particle morphology and to stabilize the polymer as a colloid. Exemplary surfactants include, but are not limited to, silicon or fluorocarbon surfactants such as those described in U.S. Pat. No. 5,589,105 to DeSimone et al., the disclosure of which is incorporated herein by reference in its entirety. Such surfactants include for example a polydimethyl siloxane, homopolymers and block copolymers, as well as poly(1,1-dihydroperfluoro octyl acrylate) homopolymers and block copolymers. The surfactants may be included in various amounts, preferably from about 0 to about 20 percent based on the weight of the monomers.

The method of the invention may be carried out in an appropriate reaction cell or vessel, suitable for high pressure application when desired. A hastelloy cell is often employed. Typically, the charge transfer agent is loaded into the cell or vessel, and the cell is charged with $CO_2$ until a pressure of about 1000 psia to about 2000 psia is reached. At the same time as the charge transfer agent addition, or subsequent to the charge transfer agent introduction, monomer is placed into the cell, and the pressure of the cell is raised to a value preferably ranging from about 2000 psia to about 10,000 psia. The reaction then proceeds for a period ranging from about 120 minutes to about 48 hours. During the reaction, the cell or vessel may be subjected to mechanical agitation by employing appropriate devices (e.g., a paddle stirrer or impeller stirrer). The temperature during the reaction ranges from about 0° C. to about 100° C. When necessary, the cell or vessel may be heated by using appropriate heating devices (e.g., a heating furnace or heating rods).

After the reaction, the $CO_2$ from the cell or vessel is preferably vented. The resulting electrically conductive polymer may be then subjected to suitable post-reaction treating. As an example, the polymer may be extracted and filtered utilizing appropriate solvents (e.g., methanol, acetone). The treated polymer is then typically dried prior to commercial use.

The method of the invention may include additional steps. In one embodiment, the formed conductive polymer may be separated from the carbon dioxide. In one example, the electrically conductive polymer is sprayed onto a substrate by employing any known and accepted procedure. More specifically, a number of substrates may be employed for this purpose including, but not limited to, those formed of metals, organic polymers, inorganic polymers, ceramics, textiles, and composites thereof. Typically, the electrically conductive polymer is spray-coated onto a substrate.

In another embodiment, the separated conductive polymer may be washed with an aqueous solution. The aqueous solution may contain various suitable additives and agents which are typically employed in a solution of this type such as, for example, pH buffering agents and the like.

The following examples are to be interpreted as illustrative of the present invention, and are not construed as limiting thereof.

EXAMPLES 1–6

Synthesis of polypyrrole and polymethylpyrrole in Liquid $CO_2$

Examples 1–6 illustrate the synthesis of polypyrrole and polymethylpyrrole in liquid $CO_2$. In these examples, the polymers were synthesized in liquid $CO_2$ via a surface reaction with charge transfer agents (i.e., oxidation reagents) such as $FeCl_3.6H_2O$, $FeCl_3$, and $Cu(ClO_4)_2.6H_2O$. In each reaction, after the addition of pyrrole monomer, the color of the $CO_2$ changed from colorless to black (pyrrole black). In general, a yield of 76 to 100 percent of the pyrrole black was achieved with the conductivity ranging from $10^{-5}$ to $10^{-6}$ $Scm^{-1}$ independent of the amount of oxidation reagent used in the reaction. It should be noted that a higher yield can be obtained by employing a higher ratio of oxidation reagent to monomer in certain oxidation reagent-to-monomer ratio ranges.

When MeOH, $FeCl_3$ (or $FeCl_3.6H_2O$), and liquid $CO_2$ were present in the same reaction cell at pressures between 1,000 and 5,200 psia, a phase separation occurred. The bottom layer consisted of a brown MeOH solution containing $FeCl_3$ (or $FeCl_3.6H_2$), and the top layer was a lighter colored $CO_2$-containing layer. The phase separation was believed to be independent of the stirring. Accordingly, two phases were observed, namely the $CO_2$-containing layer having primarily the monomer dissolved therein, and the MeOH layer having the majority of the oxidation reagent dissolved therein. Polypyrrole synthesized by this type of reaction generally had a yield between 65 and 68 percent and a conductivity of $10^{-4}$ to $10^{-5}$ $Scm^{-1}$.

Thermogravimetric analysis of the selected polypyrrole samples revealed a typical weight loss at ca. 250° C. No significant difference was noticed between the IR spectra of the samples made in aqueous solution or liquid $CO_2$ (either surface of interfacial reaction). Also, no differences in IR spectra for the polypyrrole was observed when different oxidation reagents were employed. IR spectra revealed typical pyrrole ring vibration bands ranging from 1800 $cm^{-1}$ to 600 $cm^{-1}$.

Polymethylpyrrole was primarily synthesized by a surface reaction in liquid $CO_2$ similar to the procedure used for polypyrrole synthesis. In general, a black powder-like substance was obtained in a yield of 63 percent and having a conductivity of $2.7\times10^{-5}$ $Scm^{-1}$.

EXAMPLE 1

7.6 g of $FeCl_3.6H_2O$ (28 mmol) was placed in a 25 ml hastelloy cell with mechanical stirring. After the cell was purged for 15 min with Ar, the cell was charged with $CO_2$ until the pressure reached 1500 psia over ca. $FeCl_3$ was insoluble but finely dispersed in the cell utilizing agitation. Simultaneously, 1.0 ml (15 mmol) of degassed pyrrole monomer was placed in the addition channel, and flashed into the cell with a $CO_2$ line pressure of 5200 psia over ca. for 1 min. The color of the solution in the cell turned black immediately during the above addition. The addition was stopped after the cell pressure reached ca. 3,000 psia. The cell was vented after 4 hours of reaction at 25° C. The black powder was stirred with ca. 50 ml of $H_2O$ for ca. 1 hour and then filtered. A similar extraction and filtration procedure was carried out with methanol and then acetone for the same number of times. The black powder material was dried under high vacuum for 2 days and a yield of 0.84 g (76 percent) was obtained. The conductivity of the pressed film was determined to be $1.2\times10^{-5}$ $Scm^{-1}$. An SEM revealed that no spherical particles were present.

EXAMPLE 2

A procedure similar to Example 1 was employed except that 2.6 equivalent (relative to monomer) of $FeCl_3.6H_2O$ was used as the oxidation reagent. A yield of 94 percent of pyrrole black was obtained having a conductivity of $7.9\times10^{-6}$ $Scm^{-1}$.

EXAMPLE 3

A procedure similar to Example 1 was employed except that 2.5 equivalent (relative to monomer) of $FeCl_3$ was used as the oxidation reagent. A yield of 100 percent of pyrrole black was obtained having a conductivity of $1.2\times10^{-5}$ $Scm^{-1}$.

EXAMPLE 4

A procedure similar to Example 1 was employed except that 2.0 equivalent (relative to monomer) of $Cu(ClO_4).6H_2O$ was used as the oxidation reagent. The blue surface of the oxidation reagent changed to black immediately after the addition of the monomer. After a workup process similar to Example 1, a yield of 86 percent of pyrrole black was obtained having a conductivity of $6.9\times10^{-6}$ $Scm^{-1}$.

EXAMPLE 5

Polymethylpyrrole was synthesized following a process similar to that recited in Example 1 above. 1.3 ml (14 mmol) of degassed methylpyrrole and 7.6 g (28 mmol) of $FeCl_3.6H_2O$ was used. A yield of 63 percent black powder was obtained having a conductivity of $2.7\times10^{-5}$ $Scm^{-1}$.

EXAMPLE 6

7.6 g (28.1 mmol) of $FeCl_3.6H_2O$ was added to 5.0 ml of MeOH in a 25 ml hastelloy cell equipped with mechanical stirring. After purging the cell for 15 min with Ar, the cell was charged with ca. 1,220 psia of $CO_2$. After 15 min. of stirring, a solution with two layers was observed. The top layer was clear having $CO_2$ and MeOH and the bottom layer was brownish containing an MeOH solution which contained $FeCl_3.6H_2O$. At this time, 1.0 mol (14.9 mmol) of degassed pyrrole monomer was placed in an addition valve (ca. 5 ml in volume), and then flashed into the cell with the $CO_2$ over ca. 5 min. The color of the solution in the cell turned black immediately after the addition. The addition was halted after the cell pressure reached ca. 4,500 psia. The cell was vented after 44 h. of stirring. A workup of the product similar to that described in Example 1 was followed. The yield of the black powder was 0.75 g (68 percent) with a conductivity of $2.1\times10^{-5}$ $Scm^{-1}$.

EXAMPLES 7–10

Synthesis of poly(2,2'-bithiophene), polythiophene, and poly(3-alkylthiophene) in Liquid $CO_2$ Examples 7–10 illustrate the synthesis of poly(2,2'-bithiophene), polythiophene, and poly(3-alkylthiophene) in liquid $CO_2$. Poly(2,2'-biothiophene was obtained by the oxidation polymerization of 2,2'-biothiophene and $FeCl_3.6H_2O$. Thiophene was oxidatively polymerized by $FeCl_3$ in liquid $CO_2$. 3alkylthiophene (wherein alkyl is preferably methyl, hexyl, or dodecyl) was also synthesized using $FeCl_3$ as the oxidation reagent in liquid $CO_2$.

The pressures in all of these reactions ranged from 3,000 to 5,000 psia. Generally, a yield of black powder ranging from 70 to 90 percent was obtained. Measured conductivities of the powder ranged from $3.3\times10^{-3}$ to $1.7\times10^{-6}$ $Scm^{-1}$. The IR spectra of the samples revealed a sharp band at 780 $cm^{-1}$ which is the characteristic C-H bending mode of 2,5-substituted thiophene. TGA analysis under nitrogen revealed the product to be stable from 300° C. to 350° C. under nitrogen.

EXAMPLE 7

4.3 g (16 mmol) of $FeCl_3.6H_2O$ and 1.0 g (6.0 mmol) of 2,2'-bithiophene were placed in a 25 ml hatelloy cell. The cell was purged with Ar for 15 minutes. During this time, the two solids were kept relatively separate from each other. Subsequently, the cell was sealed and $CO_2$ was introduced into the cell until the cell pressure reached ca. 1,778 psia. The color of the cell contents changed quickly from brown to dark during the $CO_2$ addition. The reaction proceeded for 22 hours with mechanical stirring. After this time, the cell was vented and a black powder was obtained. A workup process similar to Example 1 was followed. The yield of a fine black powder was 0.81 g (71 percent). The conductivity of the material was determined to be $5.5\times10^{-3}$ $Scm^{-1}$.

EXAMPLE 8

4.7 g of $FeCl_3$ (29 mmol) was placed in a 25 ml hastelloy cell and was purged with Ar for ca. 15 min. The cell was sealed and $CO_2$ was added into the cell until the pressure reached ca. 1,100 psia. During this time, the cell contents were mechanically stirred for ca. 20 min. Simultaneously, 1.0 ml (12.5 mmol) thiophene (degassed with Ar) was introduced in an addition valve (ca. 5 ml in volume) and was then charged with $CO_2$ having a line pressure of 5,200 psia. After 5 minutes, the thiophene was added into the cell with the line pressure. The addition was carried out until the cell pressure reached 4,341 psia at 25° C. The color of the cell contents changed quickly from dark brown (the color of $FeCl_3$) to dark during the $CO_2$ addition. After 46 hours of reaction, the cell was vented and a black powder was obtained. Following a workup process similar to that used in Example 7, a yield of 0.90 g (75 percent) of black powder was obtained having a conductivity of $5.0\times10^{-5}$ $Scm^{-1}$.

EXAMPLE 9

Poly(3-methylthiophene) was synthesized by a procedure similar to that followed in Example 8. 0.5 ml (5.2 mmol) of methylpyrrole and 2.0 g (12 mmol) of $FeCl_3$ were reacted for 12 hours. A black powder material was obtained having a conductivity of 5.1×10−5 $Scm^{-1}$.

EXAMPLE 10

2.10 g (16.0 mmol) of $FeCl_3$ was placed in a 25 ml hastelloy cell and was purged with Ar for ca. 15 min. $CO_2$ was added until the cell pressure reached 1,083 psia. The cell was then sealed. The cell was mechanically stirred for ca. 20 min. Simultaneously, 1.0 ml (6.0 mmol) of 3-n-butylthiophene (degassed with Ar) was added into an addition valve (ca. 5 ml in volume) and the valve was charged with $CO_2$ having a line pressure of 5,200 psia. After ca. 5 min., the 3-n-butylthiophene was added into the cell under the line pressure until the cell pressure reached 4,764 psia at 23.2° C. The color of the cell contents changed quickly from dark brown to dark during the addition of the $CO_2$. After 18 hours, the reaction cell was vented and a black powder was obtained. Using a workup process similar to Example 7, a yield of 0.68 g (68 percent ) of black powder was obtained. The black powder was found to soluble in a common organic solvent such as THF. GPC analysis revealed that the material had a $M_w$=$9.9\times10^4$ and a PDI=3.3. The conductivity was determined to be $1.7\times10^{-6}$ $Scm^{-1}$.

EXAMPLE 11

Poly(dodecylthiophene) was synthesized according to procedures set forth by the invention. A 100 mg polymer sample was dissolved in 10 ml of toluene and then casted into a film. The conductivity of the film was measured to be between $10^{-4}$ and $10^{-5}$ $Scm^{-}$. The film was then exposed to $I_2$ vapor for 30 minutes. The conductivity of the doped film was determined to be approximately 10 $Scm^{-1}$.

In the specification and examples, there have been disclosed typical preferred embodiments of the invention and, although specific terms are employed, they are used in a generic and descriptive sense only and not for purposes of limitation of the scope of the invention being set forth in the following claims.

That which is claimed is:

1. A method of forming an electrically conductive polymer, said method comprising:

providing a reaction mixture comprising carbon dioxide, at least one monomer capable of forming an electrically conductive polymer, and a charge transfer agent; and polymerizing said at least one monomer in said reaction mixture to form an electrically conductive polymer, wherein said electrically conductive polymer is doped with said charge transfer agent.

2. The method according to claim 1, wherein said carbon dioxide is liquid carbon dioxide.

3. The method according to claim 1, wherein said carbon dioxide is supercritical carbon dioxide.

4. The method according to claim 1, wherein said carbon dioxide is gaseous carbon dioxide.

5. The method according to claim 1, wherein at least one monomer capable of forming an electrically conductive polymer is selected from the group consisting of methylpyrrole, 2,2'-bithiophene, 3-n-butylthiophene, $S_4N_4$, 1,6-heptadiene, butenyne, benzene, p-dichlorobenzene, aniline, furan, thiophene, selenophene, pyrrole, thieno[2,3-b]thiophene, thieno[3,2-b]pyrrole, isothianaphlene, fluorene, carbazole, dibenzothiophene, dithieno[3,2-b:2',3'-d]thiophene, cyclopenta[2,1-b:3',4'-b]dithiophen-4-one, n-hexylpyrrole, acetylene, and mixtures thereof.

6. The method according to claim 1, wherein said electrically conductive polymer is selected from the group consisting of poly(sulfurnitride), polyacetylene, poly (phenylacetylene), poly(propiolonitrile), poly(3-chloro-1-propyne), poly(trifluoro-1-propyne), poly(phenylene vinylene), poly(vinylene sulfide), poly(vinylenephenylene pyrrole), poly(p-phenylene), poly(p-phenylene oxide), poly (p-phenylene sulfide), polyaniline, polypyrrole, poly(2,2'-bithiophene), polymethylpyrrole, polythiophene, poly(3-alkylthiophene), and mixtures thereof.

7. The method according to claim 1, wherein said charge transfer agent is selected from the group consisting of $Fe(ClO_4)_3$, $FeCl_3$, $Fe(NO_3)_3$, $(NH_4)Fe(SO_4)_2$, $K_2S_2O_8$, $Cu(BF_4)_2$, $FeCl_3.6H_2O$, $KIO_3$, $(NH_4)_2S_2O_8$, $K_2Cr_2O_7$, $I_2$, $AsF_5$, and mixtures thereof.

8. The method according to claim 1, wherein said reaction mixture further comprises a co-solvent.

9. The method according to claim 1, wherein said polymerizing step is followed by the step of separating said electrically conductive polymer from said carbon dioxide.

10. The method according to claim 1, wherein said reaction mixture further comprises a surfactant.

11. A method of forming an electrically conductive polymer, said method comprising:

providing a reaction mixture comprising carbon dioxide, at least one monomer capable of forming an electrically conductive polymer, and a charge transfer agent;

polymerizing said at least one monomer in said reaction mixture to form an electrically conductive polymer, wherein said electrically conductive polymer is doped with said charge transfer agent; and separating said electrically conductive polymer from said reaction mixture.

12. The method according to claim 11, wherein said carbon dioxide is liquid carbon dioxide.

13. The method according to claim 11, wherein said carbon dioxide is supercritical carbon dioxide.

14. The method according to claim 11, wherein said carbon dioxide is gaseous carbon dioxide.

15. The method according to claim 11, wherein at least one monomer capable of forming an electrically conductive polymer is selected from the group consisting of methylpyrrole, 2,2'-bithiophene, 3-n-butylthiophene, $S_4N_4$, 1,6-heptadiene, butenyne, benzene, p-dichlorobenzene, aniline, furan, thiophene, selenophene, pyrrole, thieno[2,3-b]thiophene, thieno[3,2-b]pyrrole, isothianaphlene, fluorene, carbazole, dibenzothiophene, dithieno[3,2-b:2',3'-d]thiophene, cyclopenta[2,1 -b:3',4'-b]dithiophen-4-one, n-hexylpyrrole acetylene, and mixtures thereof.

16. The method according to claim 11, wherein said electrically conductive polymer is selected from the group consisting of poly(sulfurnitride), polyacetylene, poly (phenylacetylene), poly(propiolonitrile), poly(3-chloro-1-propyne), poly(trifluoro-1 -propyne), poly(phenylene vinylene), poly(vinylene sulfide), poly(vinylenephenylene pyrrole), poly)p-phenylene), poly(p-phenylene oxide), poly (p-phenylene sulfide), polyaniline, polypyrrole, poly(2,2'-bithiophene), polymethylpyrrole, polythiophene, poly(3-alkylthiophene), and mixtures thereof.

17. The method according to claim 11, wherein said chain transfer agent is selected from the group consisting of $Fe(ClO_4)_3$, $FeCl_3$, $Fe(NO_3)_3$, $(NH_4)Fe(SO_4)_2$, $K_2S_2O_8$, $Cu(BF_4)_2$, $FeCl_3.6H_2O$, $KIO_3$, $(NH_4)_2S_2O_8$, $K_2Cr_2O_7$, $I_2$, $AsF_5$, and mixtures thereof.

18. The method according to claim 11, wherein said mixture further comprises a co-solvent.

19. The method according to claim 11, wherein said mixture further comprises a surfactant.

20. The method according to claim 11, further comprising the step of washing said conductive polymer with an aqueous solution subsequent to said step of separating said conductive polymer from said reaction mixture.

21. The method according to claim 11, wherein said separating step comprises venting said carbon dioxide.

22. The method according to claim 11, wherein said separating step comprises spraying said mixture onto a substrate.

23. The method according to claim 11, wherein said separating step comprises spray-coating said mixture onto a substrate such that said electrically conductive polymer forms a coating thereon.

* * * * *

UNITED STATES PATENT AND TRADEMARK OFFICE

CERTIFICATE OF CORRECTION

PATENT NO. : 5,855,819

DATED : January 5, 1999

INVENTOR(S) : Joseph M. DeSimone, Yizeng Ni

It is certified that error appears in the above-identified patent and that said Letters Patent is hereby corrected as shown below:

Column 8, line 62, claim 16, "poly)p-phenylene)," should read -- poly(p-phenylene),--

Signed and Sealed this

Twenty-fifth Day of May, 1999

*Attest:*

Q. TODD DICKINSON

*Attesting Officer*

*Acting Commissioner of Patents and Trademarks*